US005242341A

United States Patent [19]

Yeh

[11] Patent Number: 5,242,341

[45] Date of Patent: Sep. 7, 1993

[54] ELECTRIC CLIMBING TRAINING DEVICE

[76] Inventor: Chin-Chen Yeh, No. 6, Lane 129, Min-Tsu Rd., Changhua City, Taiwan

[21] Appl. No.: 983,309

[22] Filed: Nov. 30, 1992

[51] Int. Cl.[5] ..... A63B 22/04

[52] U.S. Cl. ..... 482/52

[58] Field of Search ..... 482/51-54, 482/1-9, 62, 901, 72, 57

[56] References Cited

U.S. PATENT DOCUMENTS 4,726,581 2/1988 Chang ..... 482/53
4,900,013 2/1990 Rodgers, Jr. ..... 482/72 X
5,145,475 9/1992 Cares ..... 482/62 X

*Primary Examiner*—Stephen R. Crow
*Assistant Examiner*—Glenn E. Richman
*Attorney, Agent, or Firm*—Stanley P. Fisher

[57] ABSTRACT

This invention relates to an electric climbing training device for use as an indoor exercise device. The electric climbing training device includes a portable support body, which has a front inclined climbing portion, and an endless transmission member operated by a driving unit and carrying a plurality of foot boards to move along an endless rail formed in the portable support body. A handle is provided in the front climbing portion. An electric control unit is mounted to the support body to control movement of the foot boards.

3 Claims, 3 Drawing Sheets

ELECTRIC CLIMBING TRAINING DEVICE

BACKGROUND OF THE INVENTION

1. Field of the Invention

This invention relates to an electric climbing training device, more particularly to an electric climbing training device which primarily includes a portable support body that has foot boards provided on a front inclined climbing portion and capable of automatic descent movement by means of an electric control means which is mounted to the portable support body and which has time and speed control elements provided thereon.

2. Brief Description of the Prior Art

Rapid economic growth has made people more and more busier. Physical exercise has become essential to relieve people from stress and to improve their physical health. Indoor exercise devices are popular because of their applicability in indoor spaces. Therefore, they are in great demand in big cities which have limited open spaces for exercising. There are various indoor exercise devices, such as exercise bicycles, tread mills, rowing exercise devices, etc., which permit users to simulate outdoor exercises, such as cycling, running, treading, rowing, etc.

SUMMARY OF THE INVENTION

Climbing a ladder is one of the efficient ways for exercising the legs and for training the physical endurance of the user. An objective of this invention is to provide a novel indoor climbing training device which is convenient to use and which can enable a user to simulate a ladder climbing movement.

Another objective of this invention is to provide an electric climbing training device which has ladder foot boards which move automatically and which are operable at a controlled rate so as to accommodate the user's exercising ability.

Still another objective of this invention is to provide an electric climbing training device which has a time setting unit to evaluate the exercise endurance of the user.

According to this invention, an electric climbing training device of this invention comprises:

- a portable support body having a front inclined climbing portion;
- an endless rail means provided in said portable support body and having a descending section in the front inclined climbing portion;
- an endless transmission means mounted movably to the portable support body and movable adjacent to and along the endless rail means;
- a drive means mounted to the portable support body for driving the endless transmission means;
- a plurality of foot boards mounted to the endless transmission means at intervals, said foot boards engaging slidably the endless rail means and being carried by the transmission means along the endless rail means;

a handle means mounted fixedly to the portable support body at two sides of the foot boards, said handle means being adjacent to the inclined climbing portion; and an electric control means mounted to the portable support body to control the drive means so as to operate the foot boards, said electric control means having a time setting means and a speed adjustment means.

BRIEF DESCRIPTION OF THE DRAWINGS

A preferred embodiment of this invention will be described in detail with reference to the accompanying drawings, in which.

DETAILED DESCRIPTION OF THE PREFERRED EMBODIMENT

Figure 1:
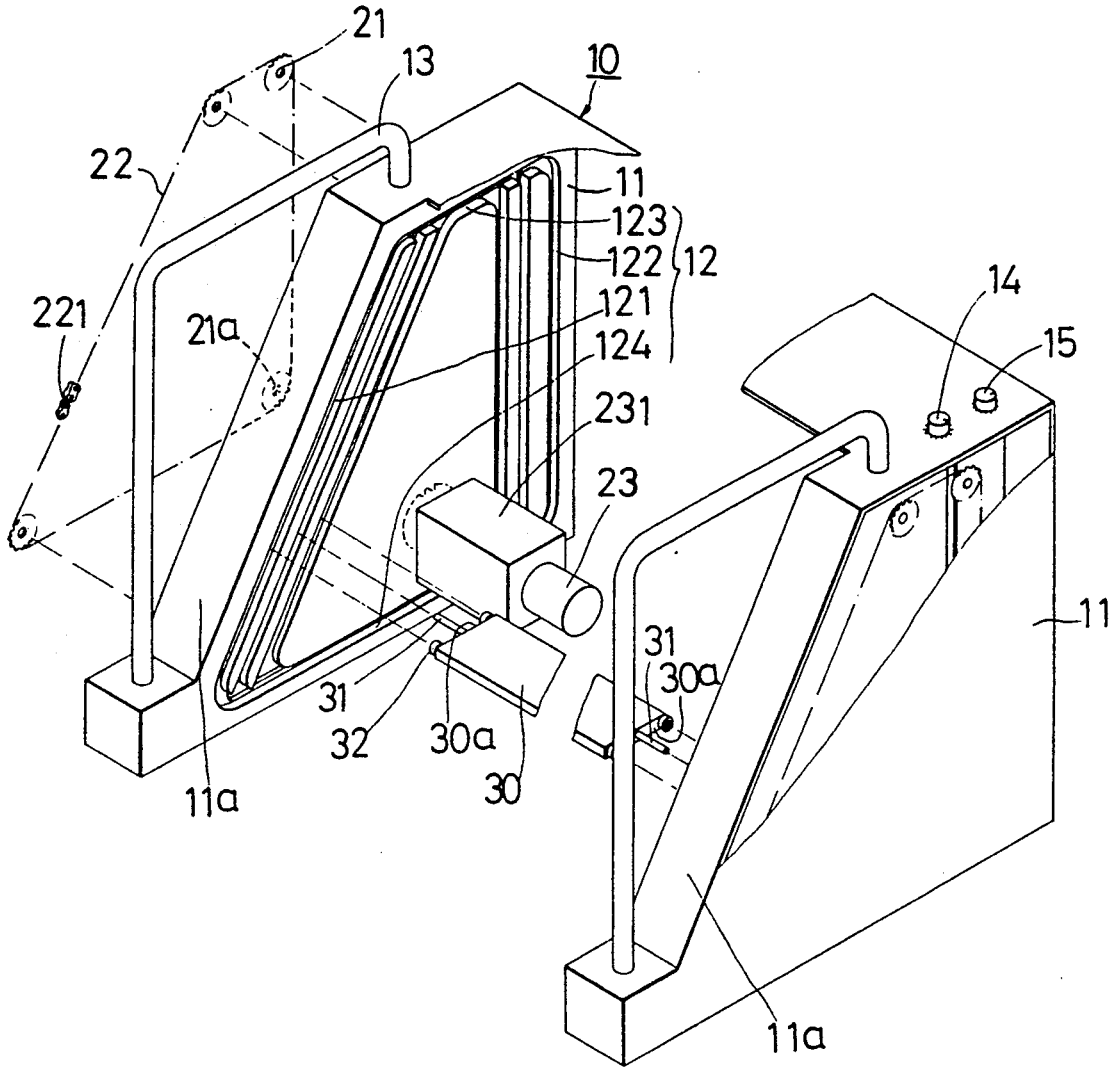
FIG. 1 is an exploded view of the preferred embodiment of an electric climbing training device according to this invention.

Referring to FIG. 1, the electric climbing training device comprises a portable support body 10 which has a front inclined climbing portion, an endless rail means 12, an endless transmission means 20, a driving means 23, a plurality of foot boards 30, a handle means 13, a time setting means 14, and a speed adjustment means 15.

The portable support body 10 includes two spaced opposite positioning plates 11, each having an inclined side 11*a* on the front inclined climbing portion of the portable support body 10.

The endless rail means is a trapezoid loop groove 12 which is provided in the inner side of each positioning plate 11. The trapezoid loop groove 12 has a front inclining descending section 121, a rear vertical ascending section 122, a top section 123 and a bottom section 124. The top section 123 and the bottom section 124 extend between the front inclining descending section 121 and the rear vertical ascending section 122. The front inclining descending section 121 and the rear vertical ascending section 122 are in the form of double tracks, while the top section 123 and the bottom section 124 are in the form of a single track.

The endless transmission means 20 is mounted movably on the portable support body 10 and ascends and descends alternatingly adjacent to and along the endless rail means 12. The endless transmission means 20 comprises two flexible transmission members 22 in the form of a transmission chain. Each flexible transmission member 22 extends between the double tracks and along the single track and passes over a set of rollers 21 which are mounted to each positioning plate 11 so as to guide and support drivingly the flexible transmission member 22. One of the rollers 21, particularly designated as 21*a* is driven by the driving means 23.

The driving means 23, such as a motor, is mounted on the portable support body 10 adjacent to the driven roller 21*a*. A speed change unit 231 is connected to the driving means 23.

The foot boards 30 are mounted on the endless transmission means 20 at equal intervals and are carried by the transmission means 20 so as to move along the endless rail means 12. Each of the foot boards 30 has two pivot pins projecting from the 20 intermediate portion of two opposite sides 30*a* thereof. The pivot pins are connected to two pivot holes 221 of the flexible transmission members 22. Each foot board 30 further has two prongs (not shown) projecting from each side 30*a*, and two rollers 32 respectively mounted to the prongs and slidingly engaging the endless rail means 12.

The handle means 13 is mounted fixedly on the portable support body 10 at two sides of the foot boards 30 and is adjacent to the inclined climbing portion of the support body 10.

The time setting means 14 and the speed adjustment means 15 are mounted on the portable support body 10 to control the driving means 23 so as to operate the foot boards 30.

Figure 2:
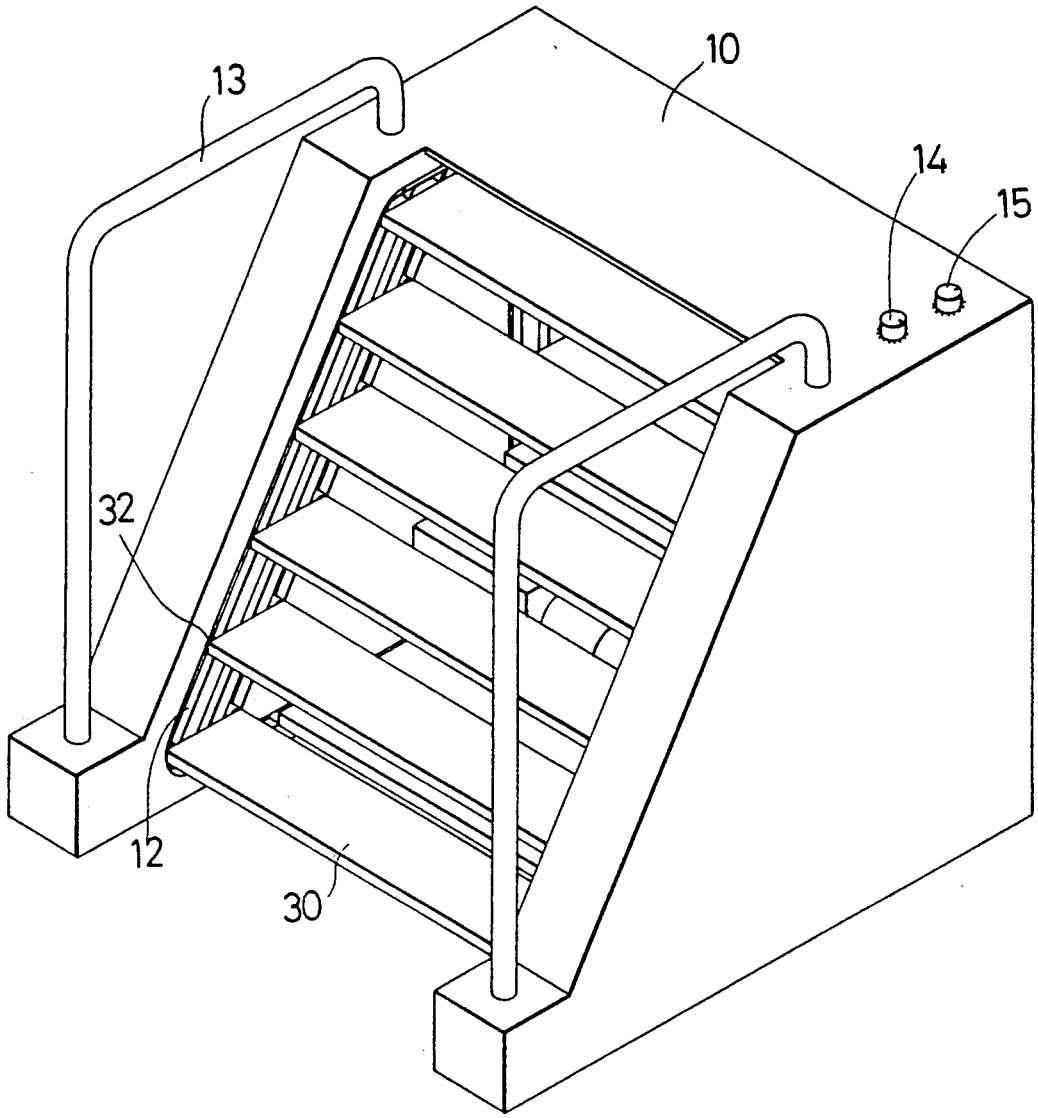
FIG. 2 is a perspective view of the preferred embodiment of an electric climbing training device according to this invention.
Figure 3:
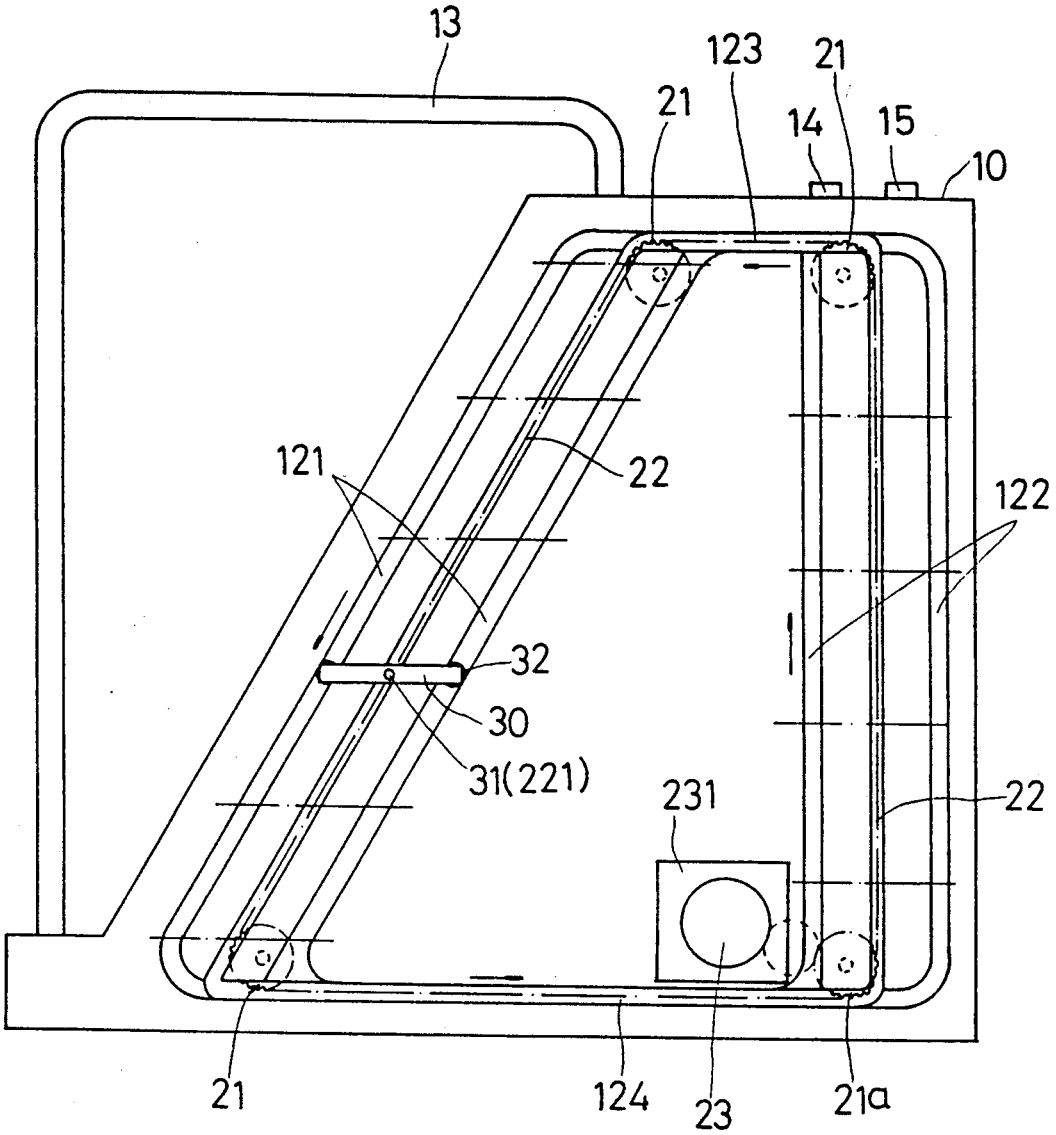
FIG. 3 is a side elevation of the preferred embodiment of an electric climbing training device according to this invention.

Referring to FIGS. 2 and 3, after assembling the elements of the electric climbing training device of the present invention, the user can set the time setting means 14 and the speed adjustment means 15 to the selected values according the desired exercise time and the desired moving speed of the foot boards 30. The power supply (not shown) to the driving means (23) is then turned on so as to drive the driven roller 21*a* at a controlled rotating rate via the speed change unit 231. The flexible transmission members 22 are driven by the driven roller 21*a* and passes over a set of rollers 21 in a counterclockwise direction. The foot boards 30 are mounted pivotally on the flexible transmission members 22 slide along the endless rail means 12 by means of the rollers 32. The foot boards 30 can descend stably along the inclined front section 121 because the rollers 32 are pivoted in the inclined front section 121. A user could step on the foot boards 30 according to the moving speed of the foot boards 30, so as to achieve the purpose of climbing exercise (as shown in FIG. 3). Furthermore, for safety purposes and for body balance, the user places his hands on the handles 13.

As shown in FIG. 3, the rollers 32 at the corners of one side of each of the foot boards 30 are held slidably by the double-track grooves at the inclined front section 121 in each positioning plate 11. This arrangement prevents the foot boards 30 from turning about the pivot pin 31 since the groove faces, which contact the two rollers 32 counteract any couple forces exerted on the foot boards 30. Therefore, the foot boards 30 are stable and safe regardless of where the user exerts a force on the foot boards.

As for the movement of the foot boards 30, referring to FIG. 3, the foot boards 30 are mounted to the front inclined section 121 of the transmission means 20 and descend along the front inclined section 121 toward the bottom of the latter. Then, the rollers 32 which are mounted on the prongs of the foot boards 30, slide horizontally toward the bottom of the rear vertical section 122. The rollers 32 ascend stably and vertically to the top of the rear vertical section 122, and then the rollers 32 move horizontally along the horizontal section 123 to the top of the front inclined section 121. The foot boards 30 move along the endless rail means 12 continuously in the aforementioned manner.

While the present invention has been described in connection with what is considered the most practical and preferred embodiment, it is understood that this invention is not limited to the disclosed embodiment but is intended to cover various arrangement included within the spirit and scope of the broadest interpretation so as to encompass all such modifications and equivalent arrangements.

I claim:

1. An electric climbing training device, comprising:

a portable support body having a front inclined climbing portion;

an endless rail unit provided in said portable support body and having a descending section in said front inclined climbing portion;

an endless transmission unit mounted movably to said support body and movable adjacent to and along said endless rail unit, said endless transmission unit descending in said front inclined climbing portions;

a drive unit mounted to said support body for driving said endless transmission unit;

a plurality of foot boards mounted to said endless transmission unit at intervals, said foot boards engaging slidably said endless rail unit and being carried by said transmission unit so as to move along said endless rail unit;

a handle unit mounted fixedly to said support body at two sides of said foot boards, said handle unit being adjacent to said inclined climbing portion; and an electric control unit mounted to said support body to control said drive unit so as to operate said foot boards, said electric control unit including a time setting unit and a speed adjustment unit; wherein said portable body comprises two spaced opposite positioning plates each having an inclined side in said front inclined climbing portion; wherein said endless rail unit includes a trapezoid loop groove provided on the inner side of each of said positioning plates, said trapezoid loop groove having a front inclining section, a rear vertical section, and a top and a bottom section extending between said front inclining section and said rear vertical section, said front inclining section and said rear vertical section being in the form of double tracks, said top and bottom sections being in the form of single track, said front inclining section forming said front ascending section.

2. The electric climbing training device as claimed in claim 1, wherein said endless transmission unit comprises a flexible transmission member extending between said double tracks and along said single track, and a set of rollers mounted to each of said positioning plates to guide and support drivingly said flexible transmission member.

3. The electric climbing training device as claimed in claim 2, wherein each of said foot boards has an intermediate portion which is connected movably to said flexible transmission member, each of said foot boards further having two rollers mounted rotatably and respectively to said prongs and engaging slidingly said trapezoid loop groove.

* * * * *